US007077171B2

(12) United States Patent
Carrubba

(10) Patent No.: US 7,077,171 B2
(45) Date of Patent: Jul. 18, 2006

(54) CONTROLLED LEAKAGE CONTAINER AND METHOD

(75) Inventor: Vincent F. Carrubba, Belle Harbor, NY (US)

(73) Assignee: Interdynamics, Inc., Tarrytown, NY (US)

( * ) Notice: Subject to any disclaimer, the term of this patent is extended or adjusted under 35 U.S.C. 154(b) by 86 days.

(21) Appl. No.: 10/850,454

(22) Filed: May 21, 2004

(65) Prior Publication Data

US 2005/0269350 A1 Dec. 8, 2005

(51) Int. Cl.
*B65B 1/04* (2006.01)

(52) U.S. Cl. ..... 141/1; 141/301; 141/351

(58) Field of Classification Search ..... 141/1, 141/2, 18, 67, 301, 302, 346–351; 222/3, 222/402.1
See application file for complete search history.

(56) References Cited

U.S. PATENT DOCUMENTS

| | | | | |
|---|---|---|---|---|
| 2,456,913 | A | 12/1948 | Buttner et al. | |
| 2,757,964 | A | 8/1956 | Both et al. | |
| 2,822,961 | A | 2/1958 | Seaquist | |
| 2,925,103 | A | 2/1960 | Kerr et al. | |
| 2,956,708 | A | 10/1960 | Nusbaum | |
| 3,029,981 | A | 4/1962 | Webster et al. | |
| 3,155,292 | A | 11/1964 | Webster | |
| 3,258,160 | A | 6/1966 | Allen | |
| 3,357,601 | A | 12/1967 | Crawford et al. | |
| 3,384,133 | A | 5/1968 | Gordon | |
| 3,452,906 | A * | 7/1969 | Daniels | 222/402.1 |
| 3,554,227 | A | 1/1971 | Yocum | |
| 3,578,788 | A | 5/1971 | Potter, Jr. et al. | |
| 3,648,893 | A | 3/1972 | Whiting | |
| 3,664,557 | A | 5/1972 | Bruce | |
| 3,759,291 | A | 9/1973 | Moore et al. | |
| 3,815,534 | A | 6/1974 | Kneusel | |
| 3,817,302 | A | 6/1974 | Kowal et al. | |
| 3,851,796 | A | 12/1974 | Moos | |
| 3,866,804 | A | 2/1975 | Stevens | |
| 3,976,110 | A * | 8/1976 | White | 141/346 |
| 3,977,560 | A | 8/1976 | Stumpf et al. | |
| 3,998,274 | A | 12/1976 | Liautaud | |
| 4,054,163 | A | 10/1977 | Brown, Jr. et al. | |
| 4,059,858 | A | 11/1977 | Lambel et al. | |
| 4,281,775 | A | 8/1981 | Turner | |
| 4,313,306 | A | 2/1982 | Torre | |
| 4,431,117 | A | 2/1984 | Genbauffe et al. | |
| 4,494,570 | A | 1/1985 | Adkins | |
| 4,545,759 | A * | 10/1985 | Giles et al. | 431/344 |
| 4,644,982 | A | 2/1987 | Hatch | |
| 4,662,393 | A | 5/1987 | Genbauffe et al. | |

(Continued)

OTHER PUBLICATIONS

Color photographs of conventional aerosol valve, including top, bottom and disassembled views, no date.

*Primary Examiner*—Steven O. Douglas
(74) *Attorney, Agent, or Firm*—Plumsea Law Group, LLC

(57) ABSTRACT

A container, a method for dispensing a fluid contained in the container and a valve are disclosed. The container includes a valve that permits the contents of the container to be dispensed and re-sealed after use. In some embodiments, the valve automatically opens when a suitable connector is attached to the container and automatically closes when the connector is removed from the container. The container can also optionally include a pressure relief system and provisions to prevent backflow into the container. The container is also designed to be backward compatible with existing hardware and connectors.

32 Claims, 10 Drawing Sheets

U.S. PATENT DOCUMENTS 4,697,611 A 10/1987 Winland et al.
4,753,267 A 6/1988 Starr et al.
4,971,224 A * 11/1990 Scremin ..... 222/3
5,022,423 A 6/1991 Britt
5,183,189 A 2/1993 Baudin
5,211,317 A 5/1993 Diamond et al.
5,232,124 A 8/1993 Schneider et al.
5,234,019 A 8/1993 Forner
5,246,045 A 9/1993 Clothier et al.
5,295,502 A 3/1994 Lane
5,305,925 A 4/1994 Vogel
5,356,045 A 10/1994 Parks et al.
5,407,096 A 4/1995 Smith
5,415,329 A 5/1995 Westlund
5,485,872 A 1/1996 Kerger
5,765,601 A 6/1998 Wells et al.
5,848,740 A 12/1998 Burghaus
5,975,151 A 11/1999 Packo
5,975,356 A 11/1999 Yquel et al.
6,016,934 A 1/2000 Moriguichi
6,030,682 A 2/2000 Marecki
6,058,960 A 5/2000 Kopp
6,089,032 A 7/2000 Trachtenberg
6,253,970 B1 7/2001 Kohn et al.
6,385,986 B1 5/2002 Ferris et al.
6,438,970 B1 8/2002 Ferris et al.
6,510,968 B1 1/2003 Tsutsui et al.
6,539,988 B1 4/2003 Cowan et al.
6,561,237 B1 5/2003 Brass et al.
6,595,486 B1 7/2003 Chen
6,648,035 B1 11/2003 Cowan et al.
6,722,141 B1 4/2004 Ferris et al.
2003/0071078 A1 4/2003 Park
2004/0040978 A1 3/2004 Groys
2004/0060605 A1 4/2004 Jhurani

* cited by examiner

CONTROLLED LEAKAGE CONTAINER AND METHOD

BACKGROUND OF THE INVENTION

1. Field of the Invention

This invention relates to a container and a method for using the container, and more particularly, to a container for storing a refrigerant and a method for delivering refrigerant while controlling leakage.

2. Related Art

Refrigerant containers are generally known in the art. Kerr et al. (U.S. Pat. No. 2,925,103), White ((U.S. Pat. No. 3,976,110), Hatch (U.S. Pat. No. 4,664,982) and Vogel (U.S. Pat. No. 5,305,925) all teach systems and containers that are adapted to store and dispense refrigerants. Vogel also teaches a container that includes a single fill feature, where the container is designed to be filled only once and includes provisions that prevent the container from being filled a second time.

The related art also teaches containers that include a pressure relief feature. Examples include Park (U.S. patent application number US 2003/0071078 A1), Tsutsui et al. (U.S. Pat. No. 6,510,968), Schneider et al. (U.S. Pat. No. 5,232,124), Stevens (U.S. Pat. No. 3,866,804), Bruce (U.S. Pat. No. 3,664,557), Webster (U.S. Pat. No. 3,155,292) and Both et al. (U.S. Pat. No. 2,757,964). These references teach systems and devices that can relief excessive internal pressure in a container.

Other references in the general art of pressurized containers include Marecki (U.S. Pat. No. 6,030,682), which teaches a number of different materials that can be used and various properties for those materials. Baudin (U.S. Pat. No. 5,183,189) teaches a pressure relief valve in combination with a primary valve. Groys (U.S. patent application number US 2004/0040978 A1) teaches a valve that can be used with a pressurized container.

While the related art teaches refrigerant containers in various forms, there are many shortcomings. Those refrigerant containers are unable to properly re-seal after a container is used in a variety of different circumstances and after a portion of its contents have been discharged. The various valve arrangements are not backward compatible with existing connections, and the use of these containers with existing connections can cause damage and failure of the valve assemblies.

The devices taught by the related art do not provide a convenient and inexpensive system that provides a pressure relief function in the event of an internal pressure build up. These and other shortcomings indicate a need for a canister that overcomes these problems and provides for the environmentally safe delivery of refrigerant.

SUMMARY OF THE INVENTION

A container for storing refrigerant is disclosed. The container includes a storage portion; an upper portion associated with the storage portion and acting as a cap for the storage portion. The upper portion includes a rim disposed about an outer periphery, a bottom portion disposed radially inward from the rim and axially spaced from the rim, and a coupling portion disposed radially inward from the bottom portion. The coupling portion has an external thread configured to mate with a corresponding internal thread. The container also includes a valve associated with the upper portion and disposed within the storage portion of the container, the valve includes an actuator including a cup. The cup is configured to receive a needle of a piercing valve. This arrangement permits the valve to be automatically opened when the coupling portion is engaged to a connector and automatically closed when the coupling portion is disengaged from the connector.

In another aspect, the actuator moves axially and the motion of the actuator opens and closes the valve.

In another aspect, the valve includes a valve gasket axially spaced from the bottom portion of the upper portion of the container.

In another aspect, the valve includes a valve gasket confronting an interior surface of the storage portion and a valve plate disposed adjacent to the valve gasket, and wherein a valve spring biases the valve plate against the valve gasket and biases the valve gasket against an inner surface of the storage portion, thereby sealing the storage portion.

In another aspect, a pressure relief system is provided.

In another aspect, the pressure relief system includes a bleeder spring biasing the actuator towards the storage portion of the container.

In another aspect, a hole is formed in a valve gasket and a valve plate to expose an exterior surface of the actuator to contents in the storage portion of the container.

In another aspect, a predetermined internal pressure of the storage portion causes the actuator to move away from the storage portion against the force of a bleeder spring biasing the actuator towards the storage portion; and wherein the separation of actuator from a valve gasket causes fluid contained in the storage portion to escape.

In another aspect, the actuator moves towards the storage portion of the container after a portion of fluid has escaped, re-sealing the storage portion of the container.

In another aspect, the invention includes provisions to prevent backflow into the storage portion of the container.

In another aspect, the provisions to prevent backflow include a check valve disposed proximate the valve.

In another aspect, the invention provides a method for dispensing fluid stored under pressure in a container comprising the steps of: engaging a connector to a coupling portion of the container by screwing the connector onto the coupling portion; moving an actuator towards a storage portion of the container by advancing the connector further onto the coupling portion; opening a valve disposed in the storage portion of the container by moving the actuator; dispensing fluid from inside the storage portion; moving the actuator away from the storage portion by unscrewing the connector from the coupling portion; and closing the valve and re-sealing the container by further unscrewing the connector from the coupling portion and moving the actuator further away from the storage portion of the container.

In another aspect, the step of opening the valve includes moving a valve gasket away from an interior surface of the storage portion of the container.

In another aspect, the step of opening the valve includes moving an actuator disk with a needle received by a cup disposed in an end of an actuator stem.

In another aspect, the step of closing the valve includes moving a valve gasket towards an interior surface of the container by using a valve spring biased to close the valve.

In another aspect, the invention provides a valve adapted for use with a refrigerant and adapted for use inside a container with a coupling portion having an external thread comprising: a valve gasket supported by a valve plate, the valve plate being biased by a valve spring disposed between a valve plate and a housing; an actuator disposed coaxial with the valve gasket and the valve plate; the actuator having a first end associated with the valve gasket and a second end including a cup, wherein the cup is adapted to receive a needle of a piercing valve; and wherein displacement of the cup by the needle moves the actuator and the actuator moves the valve gasket to open the valve.

In another aspect, the invention provides a bleeder valve spring biasing the actuator towards the valve spring.

In another aspect, the valve gasket includes an aperture proximate the actuator.

In another aspect, the invention provides a check valve disposed in a housing, the housing defining a pressure chamber.

In another aspect, the check valve includes a ball confined between a portion of the housing and a ball trap wherein the check valve prevents backflow out of the pressure chamber.

In another aspect, the actuator is capable of rotating.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENT(S)

Figure 1:
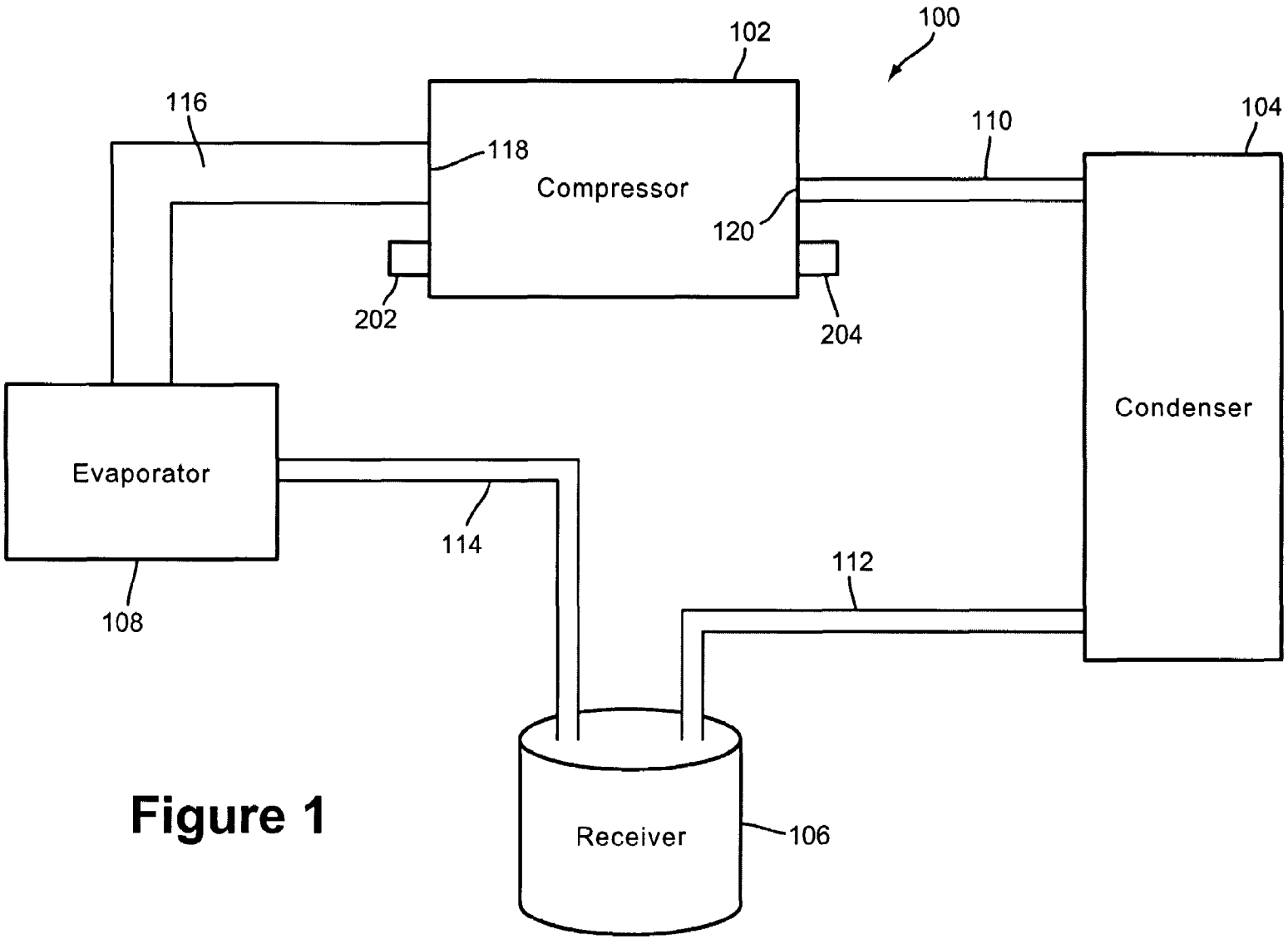
FIG. 1 is a schematic diagram of a preferred embodiment of an air conditioning system.

FIG. 1 is a schematic diagram of a preferred embodiment of an air conditioning (AC) system 100. AC system 100 preferably includes a compressor 102 having a low pressure suction port 118 receiving low pressure gas from low pressure line 116. Compressor 102 also includes high pressure discharge port 120 in flow communication with first high pressure 110. First high pressure line 110 delivers compressed gas under high pressure to condenser 104. In condenser 104, the high pressure gas is cooled to a liquid state, this high pressure liquid is then moved from condenser 104 to receiver 106 via second high pressure line 112.

Receiver 106 collects high pressure liquid and delivers the high pressure liquid, through third high pressure line 114 to evaporator 108. Evaporator 108 acts as a heat exchanger and provides cool air for use in a passenger cabin. From evaporator 108, low pressure gas is then delivered to compressor 102 via low pressure line 116. As shown schematically in FIG. 1, low pressure lines tend to be thicker than high pressure lines.

This air conditioning circuit is generally known. Over time, these kinds of AC systems experience a natural loss of the refrigerant that is used as the working fluid. The refrigerant must be periodically checked and recharged.

Generally, the high pressure portions of AC system 100 are at much higher pressures than the low pressure portions. In some cases, the high pressure portions are at a pressure that is an order of magnitude higher than the low pressure portions. Because it can be dangerous for technicians, mechanics and users to interact with the high pressure portions of the AC system, most recharging systems are designed to interact and engage the low pressure portions of AC system 100.

In the embodiment shown in FIG. 1, AC system 100 includes a low pressure portion downstream of evaporator 108 to compressor 102. This low pressure portion includes low pressure line 116 and a portion of compressor 102. In some cases, compressor 102 includes a low pressure connector 202 and a high pressure connector 204. However, it is also common to find low pressure connector 202 disposed on low pressure line 116 and high pressure connector 204 disposed on first high pressure line 110.

Figure 2:
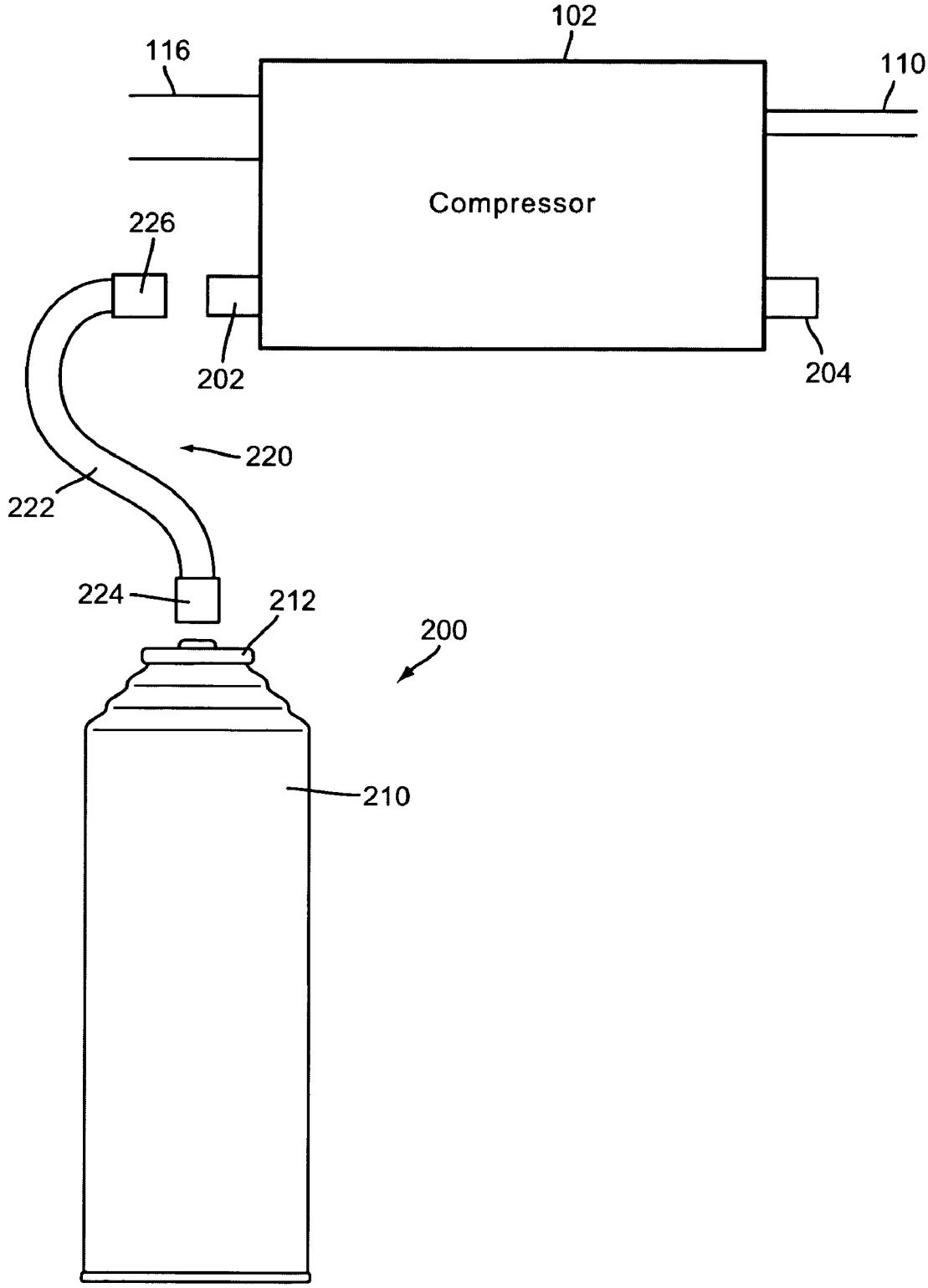
FIG. 2 is a schematic diagram of a preferred embodiment of a container and a portion of an air conditioning system.
Figure 3:
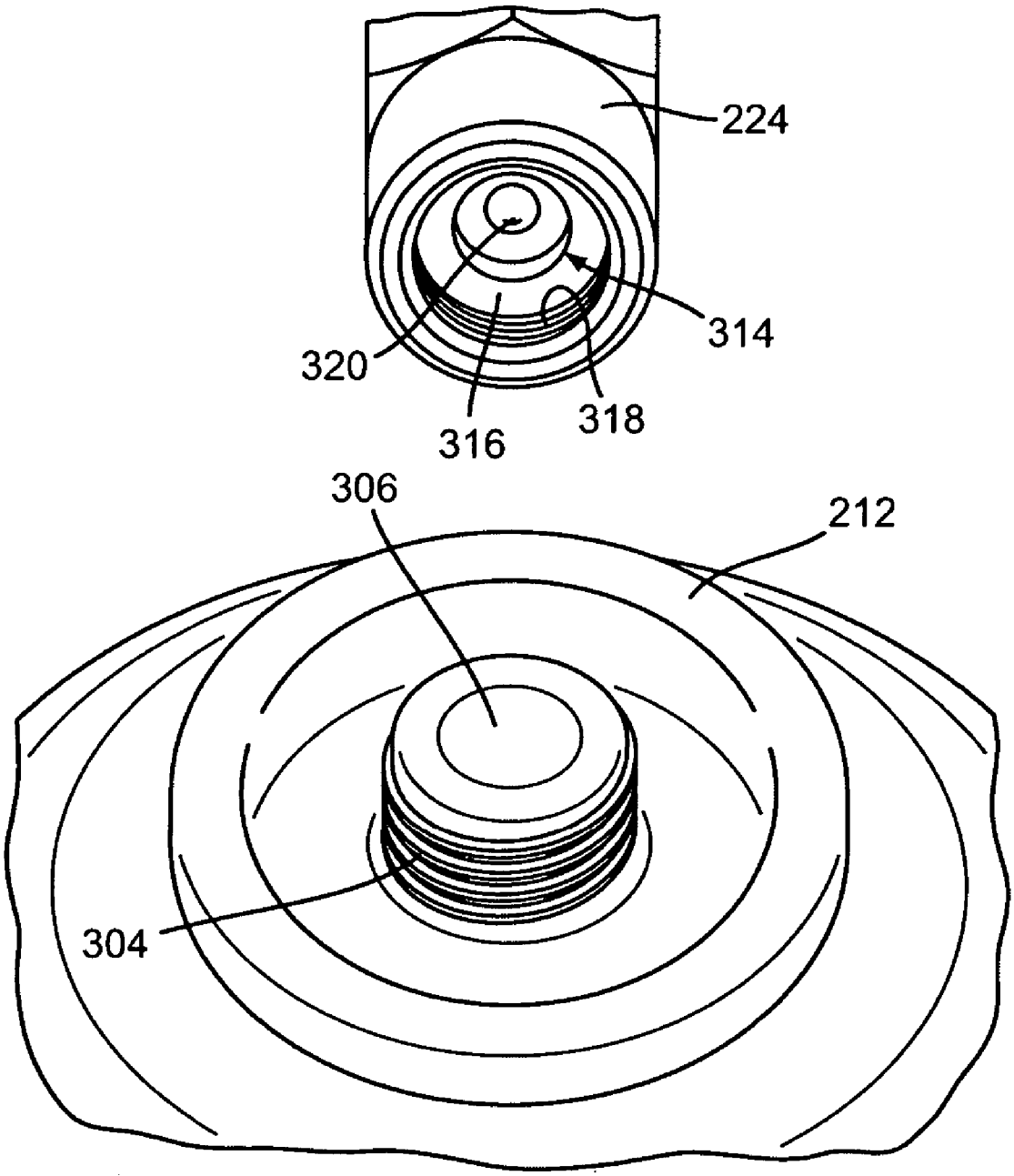
FIG. 3 is a schematic diagram of a preferred embodiment of an upper portion of a container and a connector.

FIG. 2 is a schematic diagram of schematic diagram of a preferred embodiment of a compressor 102, hose assembly 220 and container 200. Referring to FIGS. 2 and 3, to add refrigerant to AC system 100 (see FIG. 1) a container 200 containing refrigerant is placed in flow communication with low pressure connector 202 on compressor 102. In some embodiments, a hose assembly 220 is used to connect container 200 with compressor 102.

Hose assembly 220 preferably includes first connector 224 and second connector 226 disposed on opposite ends of hose 222. Preferably, second connector 226 is a quick-connect type connector and second connector 226 is adapted to engage a corresponding quick-connect type connector 202. First connector 224 can include a unique fitting. In some cases, a certain type of unique fitting has been recommended or mandated for use with certain refrigerants. In the case of refrigerant R-134a, a particular threaded connector, called an ACME thread, has been established by the EPA and SAE. Preferably, first connector 224 includes an internally threaded portion 318. Preferably, threaded portion 318 conforms to the ACME thread configuration.

Upper portion 212 of container 200 includes a rim 350 disposed about an outer periphery and a bottom portion 408 disposed radially inward from rim 350 and axially spaced from rim 350. In the embodiment shown in FIGS. 4 and 5, bottom portion 408 is closer storage portion 210 of container 200 than rim 350. a coupling portion;

Upper portion 212 of container 200 can include coupling portion 304 disposed radially inward from bottom portion 408. Preferably, coupling portion 304 includes external ACME threads that mate with internal threads 318 of first connector 224. Delivery portion 306 is disposed at an outer end of coupling portion 304. Delivery portion 306 is preferably used to convey fluid from container 200 to hose 222 via first connector 224.

A first connector gasket 316 and a needle 320 are preferably disposed within recess 314 of first connector 224. First connector gasket 316 is used to engage the outer periphery of delivery portion 306 and provides a seal. Needle 320 can be part of a piercing valve assembly where a petcock (not shown) is used to screw needle into delivery portion 306. This causes needle 320 to penetrate delivery portion 306 and place storage portion 210 of container 200 in flow communication with hose 222. In other cases, needle 320 is fixed relative to first connector 224 and the act of screwing in first connector 224 onto coupling portion 304 causes needle to penetrate into delivery portion 306. As first connector 224 is screwed on further, first connector 224 advances down coupling portion 304 along with needle 320. In some cases, needle 320 can travel anywhere from 0.250 inches up to 0.500 inches.

Figure 4:
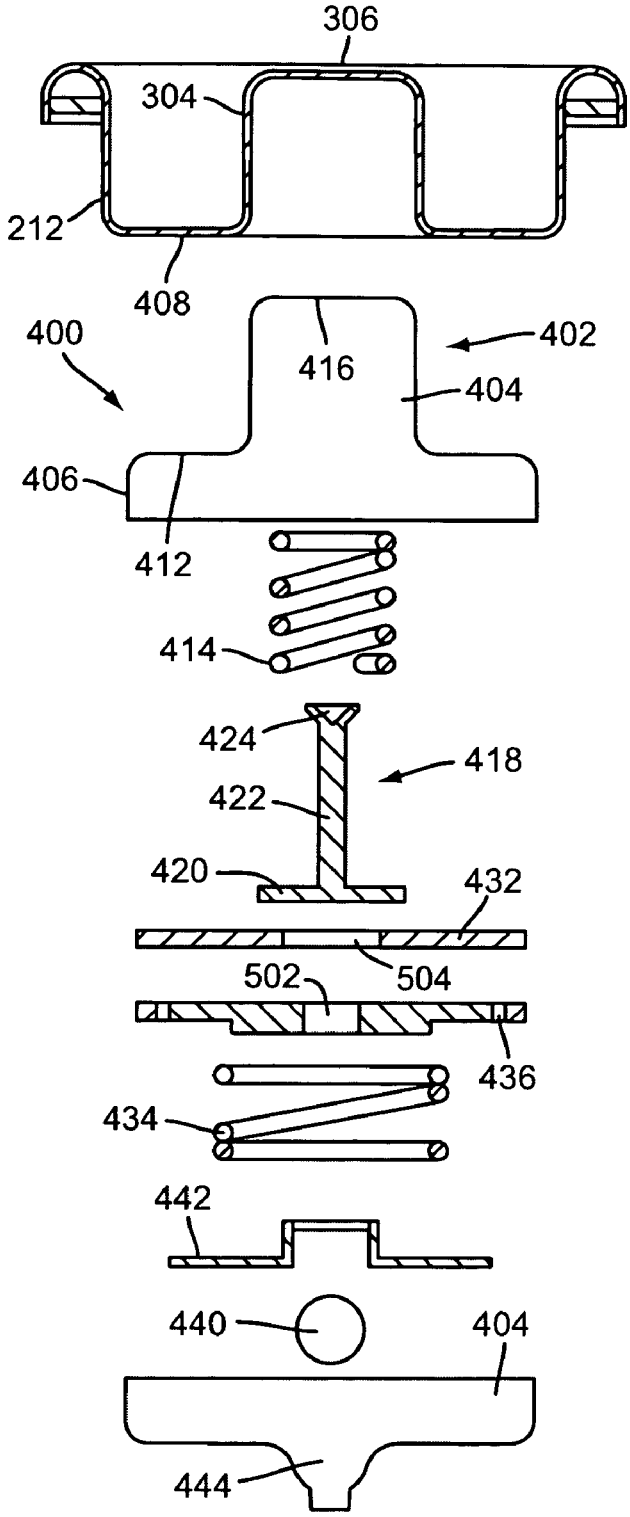
FIG. 4 is an exploded schematic diagram of a preferred embodiment of a valve and an upper portion of a container.
Figure 5:
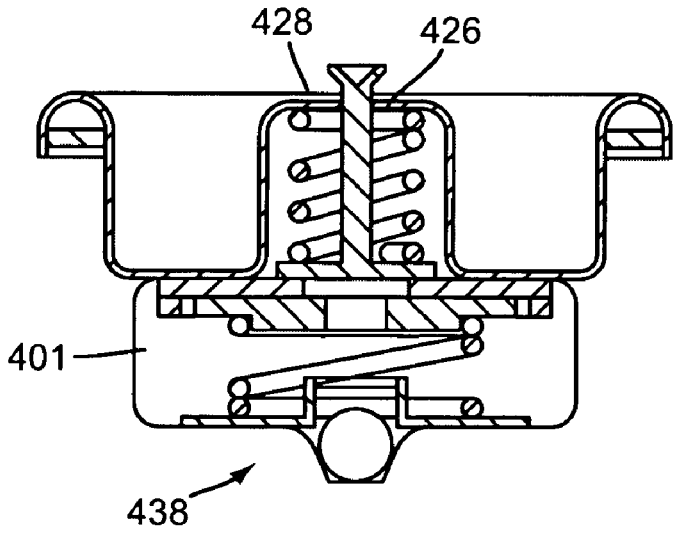
FIG. 5 is an assembled cross sectional view of a schematic diagram of a preferred embodiment of a valve and an upper portion of a container.
Figure 6:
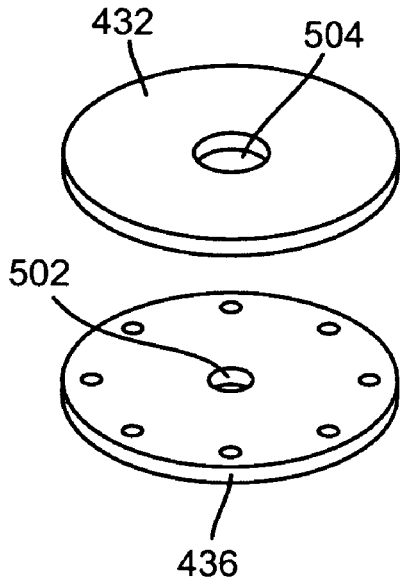
FIG. 6 is an isometric view of a schematic diagram of a preferred embodiment of a valve gasket and a valve plate.

FIG. 4 is an exploded schematic diagram of an embodiment of an internal valve 400. FIG. 5 is an assembled schematic diagram the internal valve 400 shown in FIG. 4. Referring to FIGS. 4 and 5, internal valve 400 preferably includes a housing 401. Housing 401 can be comprised of two portions, an upper housing portion 402 and a lower housing portion 404. While housing 401 can be constructed of any suitable material, a plastic, non-metallic material is preferred.

Upper housing portion 402 of housing 401 is preferably designed to mate or engage upper container portion 212. To facilitate this interface, upper housing portion 402 preferably includes projection 404 and base 406. Projection 404 is preferably received by coupling portion 304 of upper container portion 212. Base 406 includes an exterior base surface 410 and an interior base surface 412. A portion of base 406, preferably exterior base surface 410, confronts bottom portion 408 of upper container portion 212. Interior base surface 412 preferably faces the interior of storage portion 210 (see FIG. 2), and in some embodiments, interior base surface 412 serves as an interior surface of storage portion 210.

In the embodiment shown in FIGS. 4 and 5, projection 404 receives bleeder spring 414, which is preferably disposed between interior projection surface 416 and actuator 418. Preferably, actuator 418 includes an actuator disk 420 and an actuator stem 422. Actuator stem 422 preferably includes a cup 424 disposed opposite actuator disk 420.

In the embodiment shown in FIGS. 4 and 5, one end of bleeder spring 414 engages interior projection surface 416 and the other end of bleeder spring 414 engages actuator disk 420. Actuator stem 422 preferably extends through in the inside of bleeder spring 414 so that bleeder spring 414 is coaxial and radially outward of actuator stem 422. Actuator stem 422 can extend through projection hole 426 in projection 402 and delivery portion hole 428 in delivery portion 306. But in other embodiments, actuator stem 422 does not extend through those holes and remains recessed within projection 402. Cup 424 can also remain recessed within projection 402. In other embodiments, cup 424 can be disposed outside delivery portion 306 and container 200. Projection cavity 430 is in flow communication with the outside of container 200 via projection hole 426 and delivery portion hole 428.

Actuator disk 420 preferably confronts valve gasket 432. Valve gasket 432 can be made of any suitable material, however, a rubber-type material is preferred. Valve gasket 432 is preferably formed in a disk shape and engages interior base surface 412. The size or diameter and the thickness of valve gasket 432 can be varied to suit different pressures, flow rates, refrigerants and other performance objectives. Valve gaskets that have diameters between 30–95% of the diameter of interior base surface 412 are contemplated. In the embodiment shown in FIGS. 4 and 5, valve gasket 432 is preferably nearly the size of interior base surface 412. In numerical terms, the valve gasket 432 in the embodiment shown in FIGS. 4 and 5 has a diameter that is about 70–95% of the diameter of interior base surface 412. In an exemplary embodiment, valve gasket 432 has a diameter that is about 85–95% of the diameter of interior base surface 412.

Valve gasket 432 can be biased against interior base surface 412. In the embodiment shown in FIGS. 4 and 5, valve gasket 432 is biased against interior base surface 412 by valve spring 434. To assist in biasing valve gasket 432 against interior base surface 412, a valve plate 436 can be used. Valve plate 436 preferably has a diameter roughly equal to the diameter of valve gasket 432. Valve plate 436 helps to urge valve gasket 432 against interior base surface 412 and also helps to distribute the force applied by valve spring 434.

In some embodiments, valve gasket 432 and valve plate 436 are comprised of a composite material. One example is an elastomeric material. In other embodiments, valve gasket 432 and valve plate 436 are formed as a single monolithic material.

Some embodiments include provisions to prevent backflow. Although any kind of backflow prevention mechanism can be used, a one way valve is preferred. Different one way valves can used, however, a ball check valve 438 is preferred. In the embodiment shown in FIGS. 4 and 5, a ball check valve 438 includes a ball 440, which is disposed between ball trap 442 and lower housing portion 404. Preferably, lower housing portion 404 includes an appropriately sized aperture 444.

Generally, ball 440 moves freely within the confines of a space created by ball trap 442 and lower housing portion 404. However, when a high pressure condition exists in projection cavity 430, housing 401 will act as a pressure chamber and the high pressure within the pressure chamber will cause ball 440 to move deeper into aperture 444. Preferably, aperture 444 is appropriately sized to capture ball 440. In some embodiments, aperture 444 has a generally decreasing diameter, and in other embodiments, aperture 444 has a rounded stepped shape designed to capture ball 440. As ball 440 becomes seated in aperture 444, the seal between ball 440 and aperture 444 becomes tighter and ball 440 prevents the high pressure condition from entering storage portion 210 (see FIG. 2). In this way, ball check valve 438 prevents backflow into storage portion 210 (see FIG. 2).

Referring to FIGS. 2–5, the operation of various features will be described. Container 200 preferably contains a liquid or gas under pressure. In an exemplary embodiment, container 200 contains a refrigerant. Container 200 can be used to store any refrigerant including Freon (R-12), R-134a or R-152a. To dispense the contents of container 200, hose assembly 220 can be used. As disclosed above, hose assembly includes hose 222, first connector 224 and second connector 226.

First connector 224 engages upper container portion 212. To avoid the improper introduction of an incompatible refrigerant into AC system 100 (see FIG. 1), standardized connectors have been established. For example, a particular connector system has been established for refrigerant R-134a. One connector includes an ACME thread and a second connector is a quick-connect assembly. In the preferred embodiment shown in FIG. 2, first connector 224 of hose assembly 220 includes an ACME thread and second connector 226 is a quick connect assembly, in accordance with the established standard.

To dispense the contents of container 200, second connector 226 is attached to low pressure connector 202 on compressor 102. After that connection has been established, first connector 224 is attached to upper portion 212 of container 200. As disclosed above, some existing connectors include a piercing valve structure. Preferably, upper portion 212 includes provisions to engage existing connectors and to insure backward compatibility with existing connectors.

Coupling portion 304 of upper portion 212 preferably includes external threads. In the embodiment shown in the Figures, those external threads are in accordance with the ACME standard. First connector 224 includes internal ACME threads and coupling portion 304 is capable of receiving first connector 224.

In some embodiments, first connector 224 can include a piercing needle 320. This piercing needle 320 is received by cup 424 on actuator stem 422. Piercing needle 320 is arranged within first connector 224 in such a way that when first connector 224 is screwed onto coupling portion 304, piercing needle 320 moves towards container 200 (downward, as shown in FIG. 3). This is a fixed needle configuration. It is also possible to use a moving needle configuration where the needle is extended and retracted by some other mechanism, like a petcock valve. In any case, piercing needle 320 engages cup 424 and moves actuator 418 away from upper portion 212 of container 200 and towards storage portion 210.

In most cases, piercing needle 320 spins as it advances axially. Preferably, actuator 418 is designed to accommodate this spinning motion of piercing needle 320. In a preferred embodiment, actuator 418 is able to spin or rotate with piercing needle 320. In the embodiment shown in the Figures, actuator 418 is symmetric, includes a smooth outer surface and does not include a key or other device that would hinder rotation.

The motion of actuator 418 urges actuator disk 420 against valve gasket 432 and begins to defect and move valve gasket 432 away from interior base surface 412 against the spring bias created by valve spring 434. Eventually, valve gasket 432 will separate from interior base surface 412. This will create a pressure differential across valve gasket 432, with higher pressure fluid inside storage portion 210 of container 200 and relatively lower pressure in projection cavity 430. This pressure difference will cause fluid to flow from storage portion 210, through projection cavity 430, and into hose 222. Because hose 222 is in flow communication with a low pressure region of compressor 102 via low pressure connector 202, fluid will flow from container 200 into compressor 102. This procedure can be used to recharge AC system 100 (see FIG. 1).

After a desired amount of fluid or refrigerant has been dispensed, first connector 224 can be disconnected from container 200. As first connector 224 is unscrewed or removed from coupling portion 304, it is preferred that the remaining contents of container 200 are sealed and leakage into the environment prevented. Preferably provisions are provided that prevent this leakage.

As shown in the Figures, as piercing needle 320 is moved away from container 200, cup 424 of actuator 418 follows the motion of piercing needle 320 because of the force applied by valve spring 434. The force applied by valve spring 434 and the motion of actuator 418 causes other components to move as well. Valve plate 436 and valve gasket 432 also move with actuator 418 towards upper portion 212. As piercing needle 320 is further withdrawn from coupling portion 304, valve gasket 432 will again contact and engage interior base surface 412. Eventually, valve gasket 432 tightly seals against interior base surface 412 and re-forms its original fluid tight seal. In this way, internal valve 400 can provide automatic actuation and automatic sealing.

This arrangement assists in retaining the unused portion of contents that remain in container 200 after use. The leakage of contents during a disconnect operation, when first connector 224 is removed from coupling portion 304 can be controlled. The amount of leakage during a disconnect operation is affected by many factors. The type of connector that is used, the way the connector is removed, the speed at which the connector is removed, the design, the material selection of the parts, and other factors affect the amount of leakage during a disconnect operation.

Preferably, the amount of leakage during a disconnect procedure is less than about 200 grams of fluid. The term fluid refers to either a gas or a liquid. Using embodiments of the present invention it is possible to reduce the amount of leakage during a disconnect procedure to 100 grams of fluid or less. It is also possible to reduce the amount of leakage even further to 50 grams of fluid or less. In some preferred embodiments, a further reduction in leakage, around 20 grams or less, during a disconnect procedure is possible. Depending on the size of upper portion 212 and projection 404, it is also possible to reduce the amount of leakage to nearly the contents of projection cavity 430. In these cases, the amount of fluid leakage during a disconnect procedure can be 10 grams of fluid or less; or even 5 grams of fluid or less. In exemplary embodiments, 2 grams or less of fluid leakage is possible. In still other exemplary embodiments, 1 gram or less of fluid leakage is possible.

As an optional feature, internal valve 400 can also include provisions to prevent catastrophic explosion or leakage. In some cases, container 200 can experience high internal pressure. This can occur if container 200 is placed in a high temperature environment. One example is a situation where container 200 is left in the trunk of an automobile. On hot sunny days, the trunk can become very hot and, in turn, heat container 200. As container 200 is heated, a high internal pressure can build. If this internal pressure becomes excessive, the structural integrity of container 200 can fail. In some cases, this failure is catastrophic and container 200 can explode. In other cases, structural failure of container 200 leads to abruptly leaks its contents.

To avoid these problems, container 200 can optionally include provisions to that provide pressure relief in the event container 200 attains a high internal pressure. This pressure relief feature is also sometimes referred to as venting or bleeding fluid. Although the pressure relief function can be provided in many different ways, it is preferred that the pressure relief function be provided by structure and components that also perform other tasks.

Referring to FIGS. 4 and 5, a preferred embodiment of a pressure relief mechanism is shown. In the embodiment shown in FIGS. 4 and 5, actuator disk 420 provides pressure relief to container 200. As internal pressure builds inside container 200, pressure will also build in the pressure chamber formed by housing 401. Preferably, a first pressure relief hole 502 is formed on valve plate 436 and a second pressure relief hole 504 is formed on valve gasket 432. These holes expose the exterior surface of actuator disk 420 to the pressure chamber.

As pressure builds in housing 401, pressure is also exerted onto the exterior surface of actuator disk 420. Eventually, the internal pressure experienced by actuator disk 420 overcomes the spring bias provided by bleeder spring 414. When this occurs, actuator disk 420 is separated from valve gasket 432 and the fluid in the pressure chamber and in storage portion 210 of container 200 is vented to the ambient environment. The dimensions and arrangement of actuator disk 420, first and second pressure relief holes 502 and 504, respectively, and bleeder spring 414 can all be adjusted to achieve a pressure relief function at a desired or pre-set internal pressure.

This arrangement offers a pressure relief function that uses some of the components that are used to evacuate container 200 and prevent leakage after a portion of the contents of container 200 have been dispensed. This preferred design is mechanically efficient and cost effective.

However, it should be kept in mind that this pressure relief feature is an optional feature and need not be used in every embodiment. For those embodiments that do not have a pressure relief feature, first and second pressure relief holes 502 and 504, respectively, need not be provided, bleeder spring 414 can be eliminated and actuator disk 420 can be attached, in some cases permanently attached, to valve gasket 432.

Figure 7:
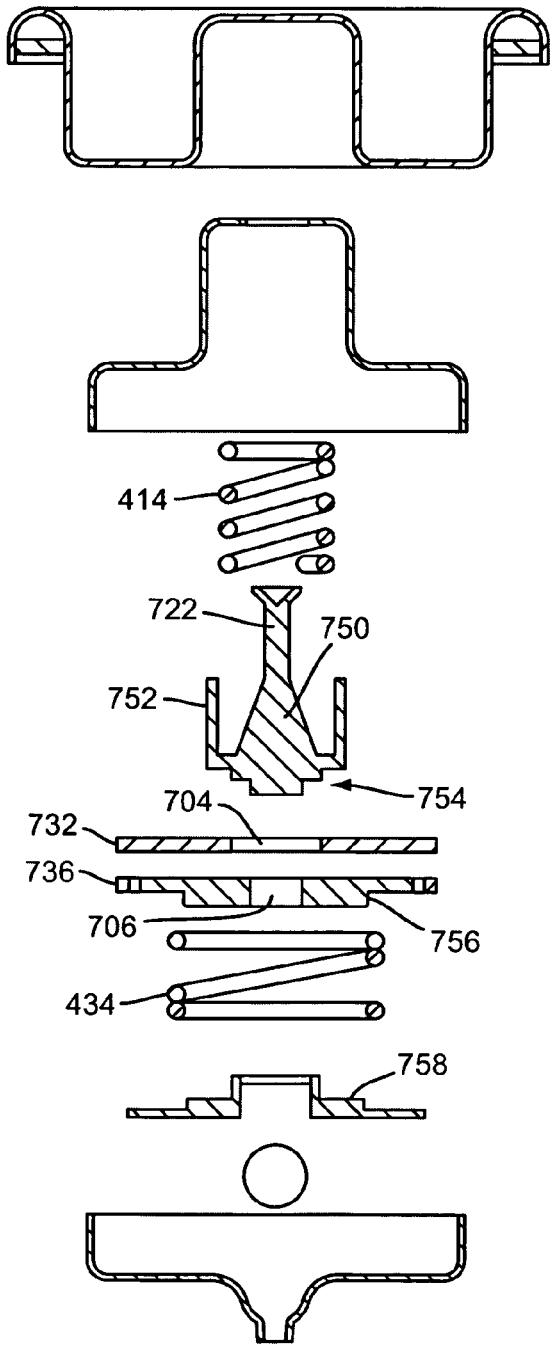
FIG. 7 is an exploded schematic diagram of another embodiment of a valve and an upper portion of a container.
Figure 8:
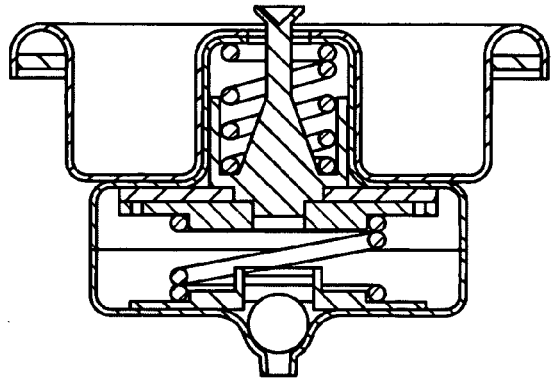
FIG. 8 is an assembled cross sectional view of a schematic diagram of another embodiment of a valve and an upper portion of a container.

FIGS. 7 and 8 show another embodiment of the present invention. The embodiment shown in FIGS. 7 and 8 include provisions that assist in aligning various components and provisions that assist in retaining the springs. Referring to FIGS. 7 and 8, a modified actuator 722 can be provided. Modified actuator includes a flared portion 750 and a cylindrical wall 752. These two components cooperate to retain bleeder spring 414. Modified actuator 722 can also include a stepped cylindrical portion 754, which helps modified actuator 722 engage modified valve gasket 732 and modified valve plate 736. Modified valve gasket 732 includes a modified bleeder aperture 704 and modified valve plate 736 similarly includes a modified bleeder aperture 706. Preferably, the two bleeder apertures 704 and 706 are of different sizes and the two apertures are preferably designed to engage respective portions of stepped cylindrical portion 754 of modified actuator 722.

The embodiment shown in FIGS. 7 and 8 also includes provisions for retaining valve spring 434. A first boss 756 is preferably formed on the side of modified valve plate 736 that faces valve spring 434 and a second boss 758 is preferably formed on the side of ball trap 758 that faces valve spring 434. The two bosses 756 and 758 provide a circumferential shoulder that is coaxial and disposed radially inward of each end of valve spring 434. These bosses 756 and 758 help to align and retain valve spring 434 and help to prevent lateral displacement of valve spring 434 during use.

Figure 9:
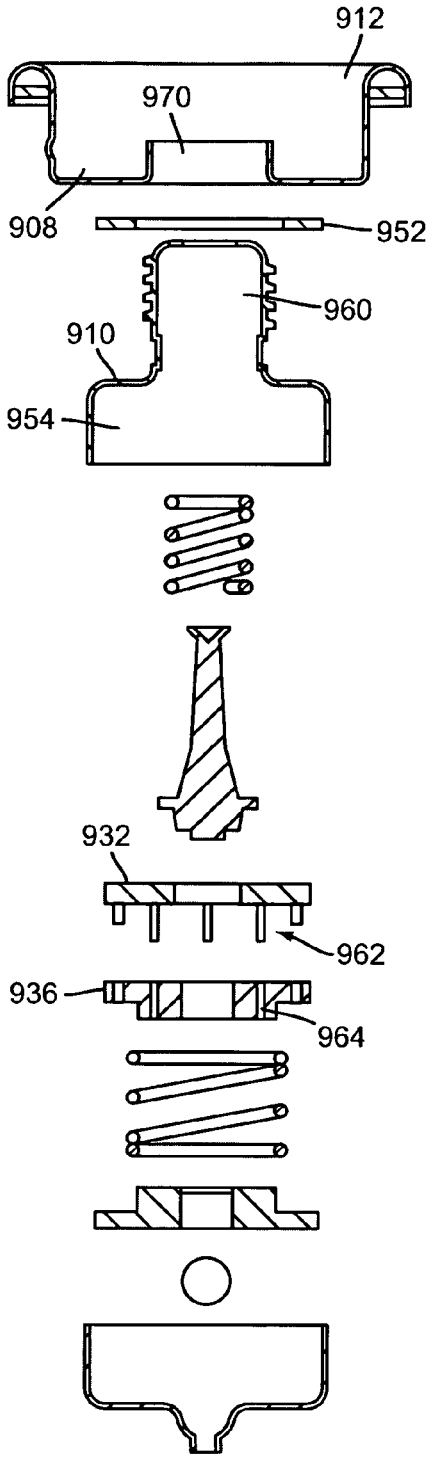
FIG. 9 is an exploded schematic diagram of another embodiment of a valve and an upper portion of a container.
Figure 10:
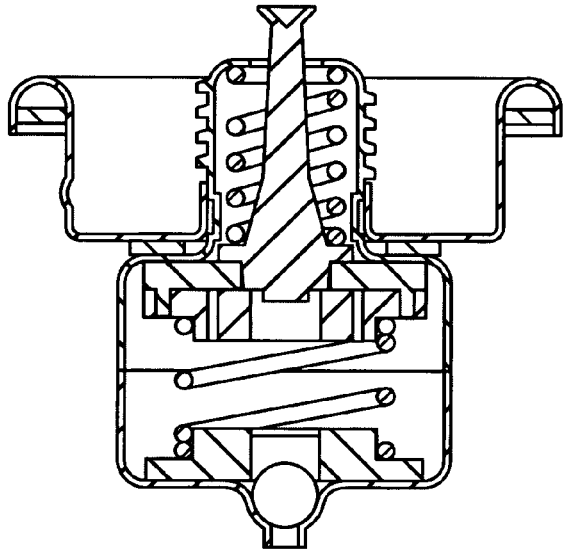
FIG. 10 is an assembled cross sectional view of a schematic diagram of another embodiment of a valve and an upper portion of a container.

FIGS. 9 and 10 show another embodiment of the present invention. In this embodiment, upper portion 912 of container 200 (see FIG. 2) includes a central aperture 970 that is adapted to receive coupling portion 960 of housing 954. This embodiment differs from other embodiments because the threads are formed on upper housing member 954 as opposed to upper portion 912 of container 200 (see FIG. 2). To help assist in sealing upper housing member 954, upper housing seal 952 can be provided. This seal 952 is disposed between external base surface 910 and bottom portion 908 of upper portion 912.

This embodiment also shows a modified valve gasket 932 and a modified valve plate 936. Modified valve plate 936 includes one or more holes 964 and modified valve gasket 932 includes one or more corresponding projections 962. The projections 962 preferably enter into corresponding holes 964. This can help stabilize modified valve gasket 932 and prevent delamination of modified valve gasket 932 from modified valve plate 936.

The modified valve gasket 932 and modified valve plate 936 assembly is preferably made by over-molding the modified valve gasket 932 on to modified valve plate 964. This helps to bond modified valve gasket 932 to modified valve plate 964. This over-molding process also helps to insure that the valve gasket material flows in to cracks and holes 964 formed on modified valve plate 936. In this way, projections 962 are formed in holes 964. Regardless of the embodiment and the configuration of the valve gasket and the valve plate, this over-molding process is the preferred method of making the valve assembly.

Figure 11:
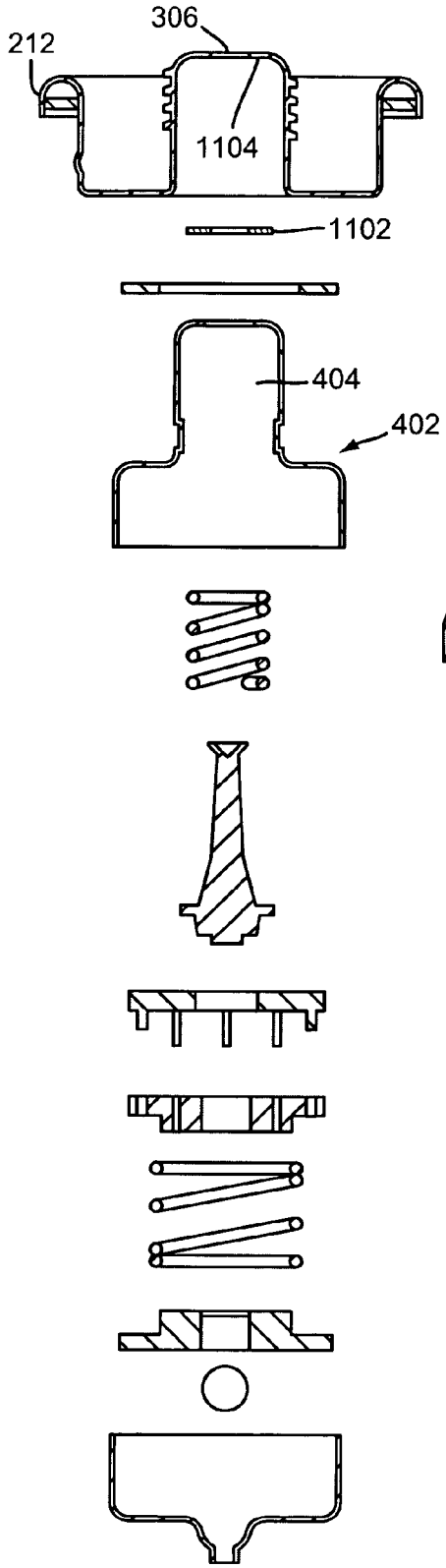
FIG. 11 is an exploded schematic diagram of another embodiment of a valve and an upper portion of a container.
Figure 12:
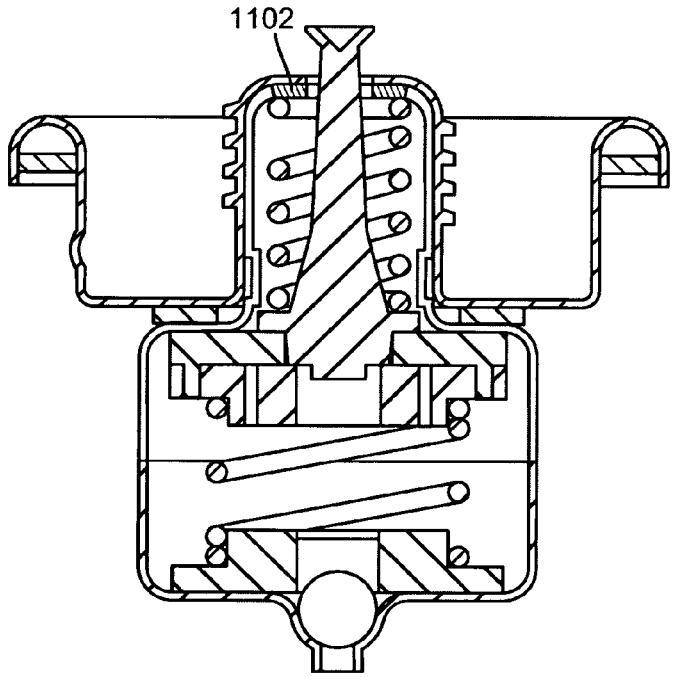
FIG. 12 is an assembled cross sectional view of a schematic diagram of another embodiment of a valve and an upper portion of a container.

The embodiment shown in FIGS. 11 and 12 include an additional seal, a delivery portion seal 1102 disposed between one end of projection 404 and the interior surface 1104 of delivery portion 306. Delivery portion seal 1102 helps to prevent fluid leakage between upper portion 212 and upper housing portion 402 in the area near delivery portion 306.

Figure 13:
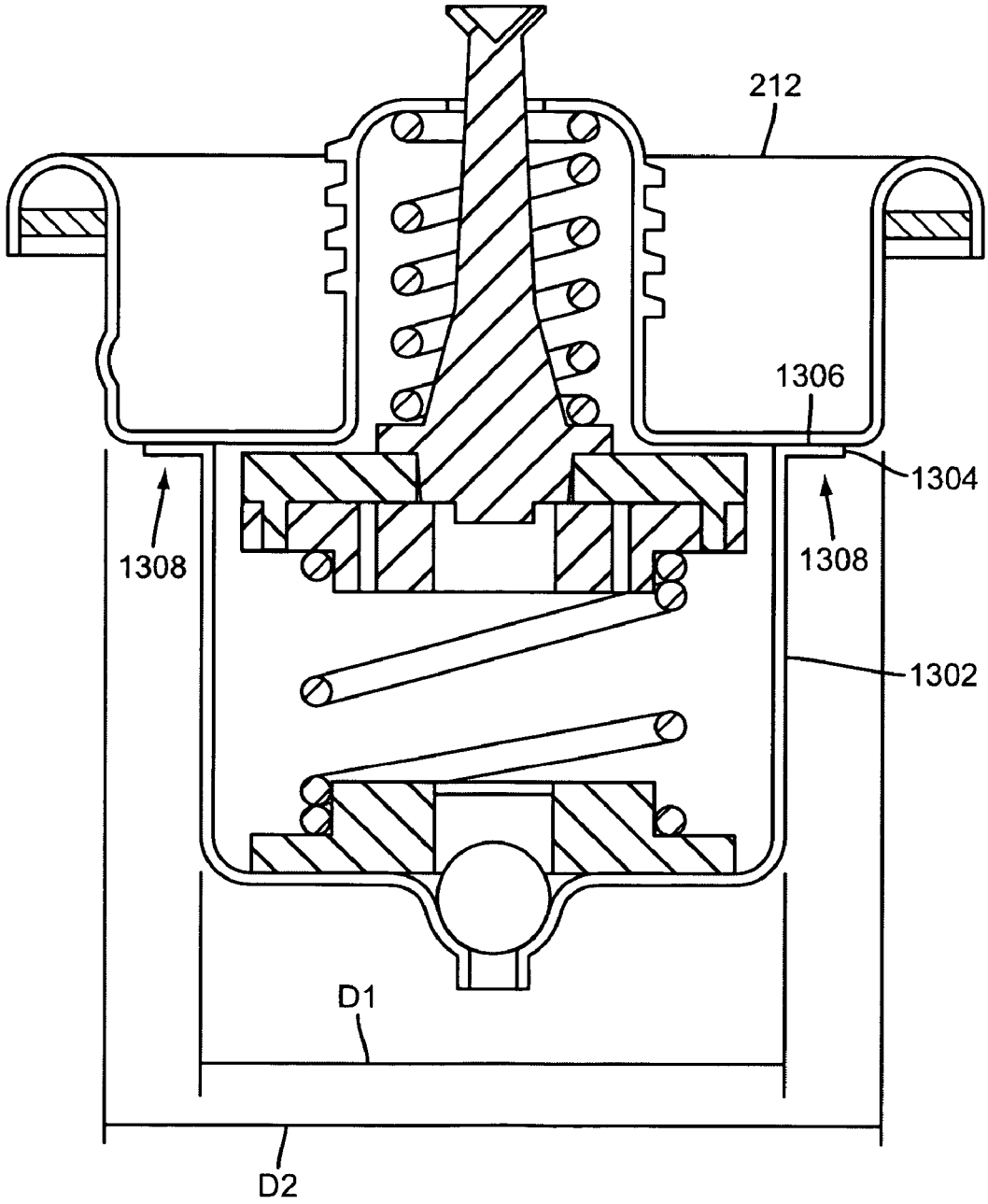
FIG. 13 is an assembled cross sectional view of a schematic diagram of another embodiment of a valve and an upper portion of a container.

FIG. 13 shows another embodiment of the present invention. In this embodiment, housing 1302 is made of a metallic material and includes a mounting flange 1304 disposed about an upper, outer periphery. Mounting flange 1304 is preferably attached to upper portion 212. In a preferred embodiment, housing 1302 is welded 1306 to upper portion 212.

It is preferred that housing 1302 is made with a diameter D1 that is less than the interior diameter D2 of upper portion 212. D1 can be any desired size. In some cases D1 can be between 30% and 95% of D2. Preferably, D1 is between 50% and 85% of D2, and in an exemplary embodiment, D1 is about 70% to 80% of D2. In one embodiment, D1 is about 75% of D2. This difference in diameter forms ledge 1308. This ledge is helpful because existing machines and conveyor systems can use ledge 1308 during manufacture.

Figure 15:
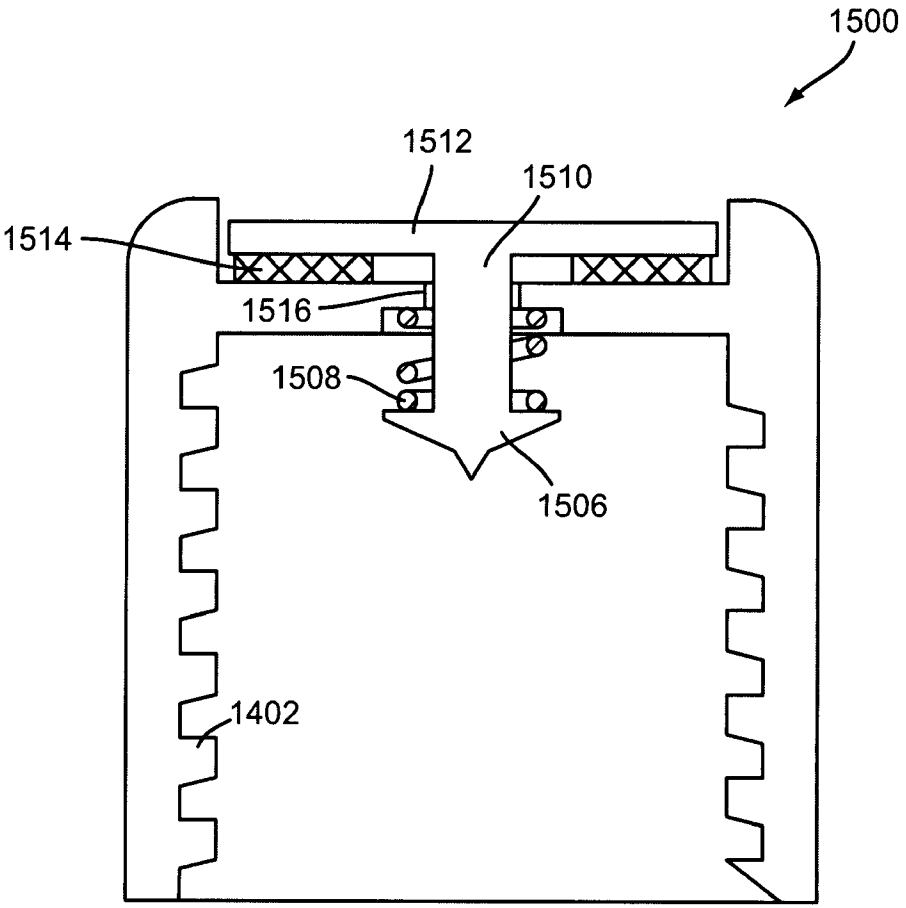
FIG. 15 is a cross sectional view of a schematic diagram of another embodiment of a cap.
Figure 14:
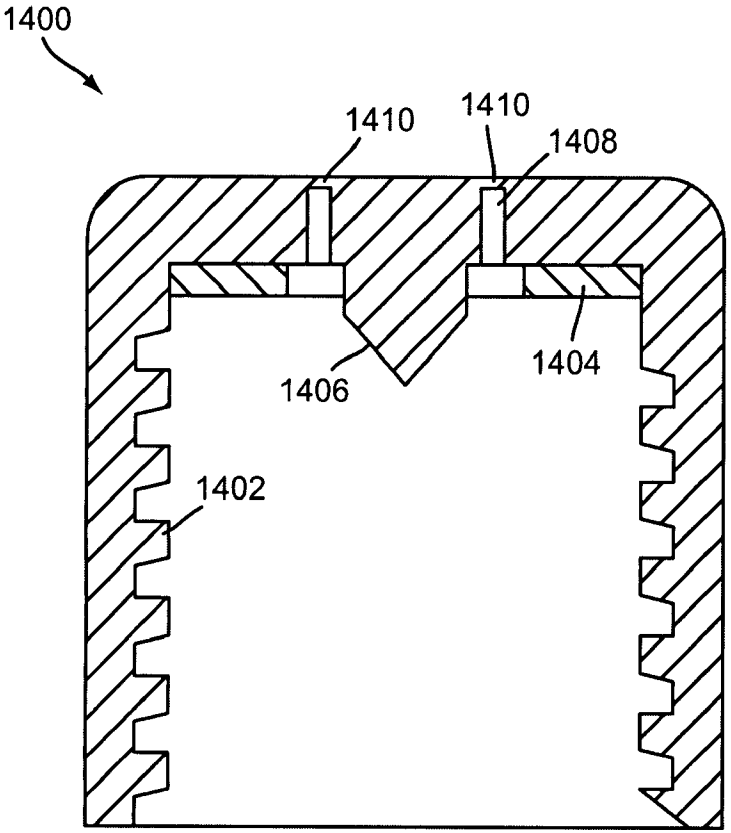
FIG. 14 is a cross sectional view of a schematic diagram of an embodiment of a cap.

FIGS. 14 and 15 show preferred embodiments of caps that can be used with containers employing some of the principles or features of the present invention. The caps 1400 and 1500 both include internal threads 1402 that are designed to mate with the external threads of coupling portion 306.

First cap 1400 can include an internal seal 1404 and a centrally located moving member 1406. Moving member 1406 is configured to engage cup 424 of actuator 418 (see FIG. 4). In the event of a high pressure condition within container 200 (see FIG. 2), actuator 418 moves away from container 200, as disclosed above. When actuator 418 moves away from container 200, cup 424 engages moving member 1406 and begins to move moving member 1406 away from container 200. Preferably, moving member 1406 is surrounded by notch 1408, which creates a low strength region 1410. This low strength region 1410 is preferably designed to fail at a predetermined level of stress or deflection. Eventually, if the internal pressure in container 200 is high enough, actuator 418 will push moving member 1406 a distance sufficient to cause failure in low strength region 1410. When this occurs, moving member 1406 acts like a blow out valve and fluid trapped within first cap 1400 escapes to the ambient atmosphere. This system is used to provide pressure relief even if first cap 1400 is screwed onto coupling portion 304.

Second cap 1500 serves a similar purpose as first cap 1400, however, second cap 1500 is re-sealable. Second cap includes moving member 1506. Like first cap 1400, moving member 1506 associated with second cap 1500 moves in response to motion by actuator 418. As moving member 1506 moves away from container 200 (see FIG. 2), moving member 1506 moves against the spring bias force provided by cap spring 1508. Moving member 1506 includes a rod 1510, which extends through cap hole 1516. Rod 1510 is also attached to a moving disk 1512. Moving disk is associated with an external cap seal 1514 that helps to prevent leakage of fluid under normal circumstances. When moving member 1506 moves against the force of cap spring 1508, moving disk 1512 eventually separates from external cap seal 1514. This allows fluid within second cap 1500 to vent via cap hole 1516 and the gap between moving disk 1512 and external cap seal 1514. In this way, second cap 1500 accommodates a pressure relief function even when second cap 1500 is secured to coupling portion 304.

Each of the various components, steps or features disclosed can be used alone or in combination with other components, steps or features. These other components, steps or features can be known or can be components, steps or features that are disclosed above. Each of the components, steps or features can be considered discrete and independent building blocks. In some cases, combinations of the components, steps or features can be considered a discrete unit.

While various embodiments of the invention have been described, it will be apparent to those of ordinary skill in the art that may more embodiments and implementations are possible that are within the scope of the invention. Accordingly, the invention is not to be restricted except as specifically recited in the following claims and their equivalents.

What is claimed is:

1. A container for storing refrigerant comprising:

a storage portion;

an upper portion associated with the storage portion and acting as a cap for the storage portion;

the upper portion including a rim disposed about an outer periphery, a bottom portion disposed radially inward from the rim and axially spaced from the rim, and a coupling portion disposed radially inward from the bottom portion;

the coupling portion having an external thread configured to mate with a corresponding internal thread;

a valve associated with the upper portion and disposed within the storage portion of the container, the valve including an actuator including a cup, the cup configured to receive a needle of a piercing valve; and wherein the valve is automatically opened when the coupling portion is engaged to a connector and automatically closed when the coupling portion is disengaged from the connector.

2. The container according to claim 1, wherein the actuator moves axially and the motion of the actuator opens and closes the valve.

3. The container according to claim 1, wherein the valve includes a valve gasket axially spaced from the bottom portion of the upper portion of the container.

4. The container according to claim 1, wherein the valve is comprised of a composite.

5. The container according to claim 1, wherein the valve includes a valve gasket confronting an interior surface of the storage portion and a valve plate disposed adjacent to the valve gasket, and wherein a valve spring biases the valve plate against the valve gasket and biases the valve gasket against an inner surface of the storage portion, thereby sealing the storage portion.

6. The container according to claim 1, further comprising a pressure relief system.

7. The container according to claim 6, wherein the pressure relief system includes a bleeder spring biasing the actuator towards the storage portion of the container.

8. The container according to claim 6, wherein a hole is formed in a valve gasket and a valve plate to expose an exterior surface of the actuator to contents in the storage portion of the container.

9. The container according to claim 6, wherein a predetermined internal pressure of the storage portion causes the actuator to move away from the storage portion against the force of a bleeder spring biasing the actuator towards the storage portion; and wherein the separation of actuator from a valve gasket causes fluid contained in the storage portion to escape.

10. The container according to claim 9, wherein the actuator moves towards the storage portion of the container after a portion of fluid has escaped, re-sealing the storage portion of the container.

11. The container according to claim 1, further comprising provisions to prevent backflow into the storage portion of the container.

12. The container according to claim 11, wherein the provisions to prevent backflow include a check valve disposed proximate the valve.

13. The container according to claim 1, wherein the external thread is an ACME thread.

14. A method for dispensing fluid stored under pressure in a container comprising the steps of:

engaging a connector to a coupling portion of the container by screwing the connector onto the coupling portion;

engaging a needle of a piercing valve, associated with the connector, with a cup configured to receive the needle of the piercing valve, the cup disposed on an actuator attached to the container;

moving the actuator towards a storage portion of the container by advancing the connector further onto the coupling portion;

opening a valve disposed in an upper portion of the storage portion of the container by moving the actuator;

dispensing fluid from inside the storage portion, a portion of the fluid flowing past portions of the valve disposed radially outward of the coupling portion;

moving the actuator away from the storage portion by unscrewing the connector from the coupling portion;

and closing the valve and re-sealing the container by further unscrewing the connector from the coupling portion and moving the actuator further away from the storage portion of the container.

15. The method according to claim 14, wherein the step of opening the valve includes moving a valve gasket away from an interior surface of the storage portion of the container and wherein the valve gasket is contained in a valve housing.

16. The method according to claim 14, wherein the step of opening the valve includes moving an actuator disk with a needle received by a cup disposed in an end of an actuator stem.

17. The method according to claim 14, wherein the step of closing the valve includes moving a valve gasket towards an interior surface of the container by using a valve spring biased to close the valve.

18. The method according to claim 14, wherein a step of disconnecting the connector from the coupling portion includes the steps of moving the actuator away from the storage portion by unscrewing the connector from the coupling portion;

closing the valve and re-sealing the container by further unscrewing the connector from the coupling portion and moving the actuator further away from the storage portion of the container, and separating the connector from the coupling portion.

19. The method according to claim 18, wherein 100 grams or less of fluid is leaked to the atmosphere during the step of disconnecting the connector from the coupling portion.

20. The method according to claim 18, wherein 50 grams or less of fluid is leaked to the atmosphere during the step of disconnecting the connector from the coupling portion.

21. The method according to claim 18, wherein 20 grams or less of fluid is leaked to the atmosphere during the step of disconnecting the connector from the coupling portion.

22. The method according to claim 18, wherein 10 grams or less of fluid is leaked to the atmosphere during the step of disconnecting the connector from the coupling portion.

23. The method according to claim 18, wherein 5 grams or less of fluid is leaked to the atmosphere during the step of disconnecting the connector from the coupling portion.

24. The method according to claim 18, wherein 2 grams or less of fluid is leaked to the atmosphere during the step of disconnecting the connector from the coupling portion.

25. The method according to claim 18, wherein 1 gram or less of fluid is leaked to the atmosphere during the step of disconnecting the connector from the coupling portion.

26. A valve adapted for use with a refrigerant and adapted for use inside a container with a coupling portion having an external thread comprising:

a valve gasket supported by a valve plate, the valve plate being biased by a valve spring disposed between a valve plate and a housing;

an actuator disposed coaxial with the valve gasket and the valve plate;

the actuator having a first end associated with the valve gasket and a second end including a cup, wherein the cup is adapted to receive a needle of a piercing valve; and wherein displacement of the cup by the needle moves the actuator and the actuator moves the valve gasket to open the valve.

27. The valve according to claim 26, further comprising a bleeder valve spring biasing the actuator towards the valve spring.

28. The valve according to claim 27, wherein the valve gasket includes an aperture proximate the actuator.

29. The valve according to claim 26, further comprising a check valve disposed in a housing, the housing defining a pressure chamber.

30. The valve according to claim 29, wherein the check valve includes a ball confined between a portion of the housing and a ball trap wherein the check valve prevents backflow out of the pressure chamber.

31. The valve according to claim 29, wherein the check valve includes a ball confined between a portion of the housing and a ball trap wherein the check valve prevents backflow past the actuator.

32. The valve according to claim 26, wherein the actuator is capable of rotating.

* * * * *